United States Patent [19]

Tshudy

[11] 4,197,344

[45] Apr. 8, 1980

[54] PROCESS AND APPARATUS FOR REDUCING SURFACE GLOSS

[75] Inventor: James A. Tshudy, Ephrata, Pa.

[73] Assignee: Armstrong Cork Company, Lancaster, Pa.

[21] Appl. No.: 922,308

[22] Filed: Jul. 6, 1978

[51] Int. Cl.[2] ..... B05D 3/06

[52] U.S. Cl. ..... 428/212; 118/58; 118/620; 204/159.22; 427/44; 427/54.1; 427/412.1

[58] Field of Search ..... 427/44, 53, 54, 407 C; 204/159.22; 428/141, 195, 212; 118/620, 58

[56] References Cited

U.S. PATENT DOCUMENTS

| | | | |
|---|---|---|---|
| 3,501,390 | 3/1970 | Turner | 427/44 |
| 3,714,007 | 1/1973 | Borrel et al. | 427/44 |
| 3,723,120 | 3/1973 | Hummel | 96/35.1 |
| 3,783,004 | 1/1974 | Parker | 427/54 |
| 3,846,149 | 11/1974 | Meunier | 427/44 |
| 4,073,975 | 2/1978 | Buckwalter et al. | 427/170 |

*Primary Examiner*—John H. Newsome
*Attorney, Agent, or Firm*—Dennis M. Kozak

[57] ABSTRACT

A method and apparatus for reducing the surface gloss of a coating are disclosed. In one embodiment, the method comprises moving in a continuous manner a material which is to be coated, applying at least one coating composition on the material, impinging the surface of the coating composition with a fluid, partially curing the coating composition by radiation, removing any remaining fluid from the surface of the coating composition, and completing the cure of the coating composition.

17 Claims, 1 Drawing Figure

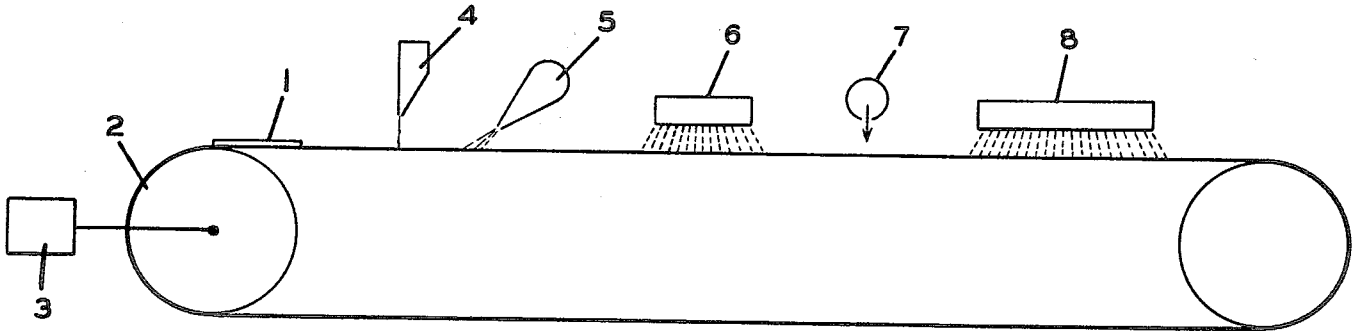
1
2
3
4
5
6
7
8

PROCESS AND APPARATUS FOR REDUCING SURFACE GLOSS

This invention relates to coatings.

More specifically, this invention relates to a process and apparatus for treating coated materials to reduce the surface gloss of the coated materials.

In one of its more specific aspects, this invention pertains to a process and apparatus for treating wear layer coated floor covering to reduce the surface gloss of the wear layer coating on the floor covering.

The resilient flooring industry is continually searching for continuous manufacturing processes for imparting, at production speeds, desirable visual effects to sheet-type and tile floor coverings. Much work has been done relating to the development of wear layer coating compositions which provide abrasion-resistance and high gloss appearance to floor coverings. Although abrasion resistance is always a desirable property of a wear layer, high gloss is not. Prior art methods of reducing wear layer gloss typically involve the employment of various particulate flatting agents in the wear layer compositions. However, the employment of flatting agents has been generally unsatisfactory since the use of a flatting agent typically results in a wear layer which exhibits poorer physical properties as compared to a wear layer not comprising a flatting agent.

This invention eliminates the need to use flatting agents by providing a novel process and apparatus for treating wear layer coating compositions such that the resulting wear layer coated floor covering exhibits reduced surface gloss as compared to wear layer coated floor covering not treated according to this invention.

According to this invention there is provided a continuous manufacturing process for reducing the surface gloss of a coating, which process comprises moving in a continuous manner a material which is to be coated on at least one surface; applying at least one coating composition, which is at least partially radiation curable, on at least a portion of the surface of the material; impinging the surface of the coating composition with a fluid to deposit some fluid on at least a portion of the surface of the coating composition; subjecting at least a part of the coating composition to a radiation precure source to partially cure the coating composition while the fluid applied above is still on the surface of the coating composition; removing substantially all remaining fluid applied above from the surface of the coating composition; and completing the cure of the coating composition.

Also, according to this invention there is provided apparatus for reducing the surface gloss of a coating, which apparatus comprises means for moving in a continuous manner a material which is to be coated on at least one surface; means for applying at least one coating composition, which is at least partially radiation curable, on at least a portion of the surface of the material; means for impinging the surface of the coating composition with a fluid to deposit some fluid on at least a portion of the surface of the coating composition; means for partially radiation curing at least a part of the coating composition while the fluid is still on the surface of the coating composition; means for removing substantially all remaining fluid from the surface of the coating composition; and means for completing the cure of the coating composition.

In one preferred embodiment, after the step of applying at least one coating composition, which is at least partially radiation curable, on at least a portion of the surface of the material and before the step of impinging the surface of the coating composition with a fluid to deposit some fluid on at least a portion of the surface of the coating composition, a portion of the coating composition is cured.

In another preferred embodiment, the process comprises applying and curing a glossy coating composition on the surface of the material to be coated prior to the step of applying at least one coating composition, which is at least partially radiation curable, on at least a portion of the surface of the material.

In another preferred embodiment, after completing the cure of the coating composition, thus producing a coated material having a reduced surface gloss, the process comprises applying and curing a glossy coating composition on a portion of the surface of the cured coating.

In another preferred embodiment, the process comprises applying a first coating composition on a portion of the surface of the material and immediately thereafter applying a second coating composition on a portion of the surface of the material, prior to impinging the surface with a fluid, the first coating composition and the second coating composition having different percent by weight radiation curable values. For example, if the first coating is 100% curable by radiation, the second coating is less than 100% curable by radiation such that, upon being processed according to this invention, a coated material having a plurality of gloss levels in different areas results. Alternatively, if the first coating is 100% curable by combined radiation and moisture cure, the second coating can be either 100% curable by radiation or 100% curable by combined radiation and moisture cure, provided that the first and second coating compositions have different percent by weight radiation curable values.

In another preferred embodiment, the fluid impinged on the surface of the coating composition is steam. It is to be understood that, although steam is preferred, this invention is not limited to the use of steam as the impinging fluid.

The coating compositions suitable for use in this invention are 100% curable by either ultraviolet or electron beam radiation or 100% curable by combined radiation and moisture cure; that is, the coating composition must be subjected to both a radiation cure step and a moisture cure step to be 100% cured.

As the coating composition, use can be made of any film forming resin or resin composition which is at least partially curable by radiation such that, when the composition is subjected to the radiation precure step of this invention, some curing occurs.

The amount of the radiation curable content in the coating composition is critical only to the extent that the coating composition must be formulated such that an effective amount of the coating composition will polymerize when subjected to the precure step of this invention to facilitate some surface gloss reduction in the end product. Typically, the coating composition is formulated such that from about 5 up to 100% by weight of the composition is radiation curable.

It has been found that the amount of surface gloss reduction obtained using this invention is directly proportional to the degree of cure achieved in the precure step. Accordingly, one skilled in the art will recognize that the amount of surface gloss reduction can be controlled by varying not only the radiation curable content of the coating composition, but also by varying other process conditions, such as, the time the coating composition is exposed to the radiation precure source and the intensity of the radiation source. For example, the conveyor speed can be varied within a range of from about 30 to about 200 feet/minute, the exposure gap on the precure system can be varied from about 2 to about 20 inches and the radiation intensity can be varied from about 0.05 to about 2 joules/cm$^2$. The above process condition ranges are provided in order to guide one in the practice of this invention and the ranges are not intended to limit the scope of this invention.

Examples of fully radiation curable resins suitable for use in this invention include "Celrad 3300 Radiation Curable Resin" and "RR-0383 Radiation Curable Resin," both commercially available from Celanese Resins Systems Division of Celanese Coatings and Specialties Company.

Celrad 3300 is a non-volatile diacrylate ester of an epoxy resin and has a viscosity at 77° F. of 8,500 cps, a free acrylic acid content of less than 1%, and a hydroxyl value of 175.

RR-0383 is a fast curing diacrylated ester of a bisphenol A type epoxy resin and has a viscosity at 77° F. of 100,000 cps, a free acrylic acid content of less than 0.5%, a hydroxyl value of 200, and is 100% active.

Although the above resins can be employed without modification, one skilled in the art will recognize that, due to the high viscosity of the materials, some viscosity reduction may be desirable depending upon the coating method employed. Since the above resins are based on epoxy resins, viscosity reduction can be achieved by blending with most diluents which are compatible with epoxy resins. Reactive mono and polyfunctional acrylate diluents are preferred in radiation cure applications because the acrylate diluents are essentially 100% converted during the photopolymerization process which results in the elimination of costly solvents and the expense of operating anti-polution systems. It will be apparent to one skilled in the art that the resultant performance properties of the resin, such as hardness and flexibility, can be altered by the selection of reactive diluents.

An example of a combined radiation and moisture curable coating composition suitable for use and employed in the practice of this invention was prepared as follows.

The following reactants were charged into a reaction vessel.

| Ingredients | Grams |
|---|---|
| Triol (Hooker F-1017-180) Reaction product of 1 mole glycerol, 3 moles of a 7/3 mixture of adipic acid and isophthalic acid, and 3 moles 1,6 hexanediol MW 960; Hydroxyl No. 175 | 93 |
| Diol (Union Carbide PCP0200) A polycaprolactone diol having a MW of 540 and a Hydroxyl No. of 207 | 58 |
| 2-ethylhexylacrylate | 94 |
| Hexanediol diacrylate | 62 |

132.3 grams of 4,4' diisocyanato dicyclhexylmethane and 0.4 grams of dibutyltin dilaurate catalyst were then added and the mixture reacted at 45° C. to 50° C. After the reaction has proceeded for approximately 45 minutes, 5.8 grams of 2-hydroxyethylacrylate was added continuing the stirring and heating for an additional two hours at which point the isocyanate functionality is constant.

Based on 100 parts by weight of the reaction mixture which is a mixture of the partially capped isocyanate terminated urethane prepolymer and the acrylate diluent mixture, 2.0% by weight of benzophenone photoinitiator is added together with 0.1% by weight of polyethylene glycol siloxane (Dow Corning DC472) and ½% by weight of dibutyltin dilaurate catalyst.

At this point, the coating composition thus formed was recovered and found to have a viscosity of approximately 9,000 centipoises at room temperature and to be comprised of 35% reactive diluents and 65% partially acrylate capped urethane prepolymer. The coating was determined to have a radiation curable content of about 40% and a moisture curable content of about 60%; the coating being 100% reactive.

The subject invention will be more easily understood if explained in conjunction with the drawing which is a schematic of the apparatus for carrying out the subject invention.

Referring now to the FIGURE, there is shown material to be coated 1 carried on means for moving 2 driven by drive means 3.

The material to be coated, after passing under means for coating 4, where a coating composition is applied, is passed under fluid impinging means 5 where a fluid is impinged on the surface of the coating composition. From the fluid impinging means, the material passes under radiation precure means 6 to partially cure the coating composition and thence is moved past fluid removing means 7 and finally through curing means 8.

In the best mode for practicing this invention, the above described apparatus operates as follows:

As the material to be coated, in this instance a commercial vinyl asbestos flooring tile to be wear layer coated, is fed along the means for moving 2, which can be any conventional conveyor system, it is first conveyed under a conventional curtain applicator 4 where the combined radiation and moisture curable coating composition described above is applied to a thickness of about 8 mils. Rather than a curtain applicator, other conventional coating applicators, such as a roll coater, blade coater, spray coater, extrusion coater, screen printer, offset printer, and the like, can be employed to apply the coating compositions to thicknesses within the range of from about 0.5 mil to about 30 mils. The tile 1, having an uncured wear layer coated surface, is now conveyed under an air knife which directs steam onto the coating surface. The air knife 5 is a conventional slotted, pressure regulated, fluid dispenser which will direct a desired amount of steam onto the surface of the coating on tile 1. However, this invention is not limited to the application of steam or to any specific type of fluid dispenser. Alternatively, the invention can be carried out by using a conventional ultrasonic spray nozzle, such as a "Sonimist" ultrasonic spray nozzle, commercially available from Heat Systems - Ultrasonics, Inc., Plainview, L.I., New York. With the ultrasonic spray nozzle structure, ethylene glycol and isopropanol have been used as the impinging fluids, sprayed on the surface of coatings on tiles, and found to provide reductions in surface gloss levels comparable to the air knife - steam system employed in the best mode. It is to be understood that, as used herein, in the impinging step, the term air knife is considered to be a fluid impinging means suitable for depositing a fluid on the coating surface on the tile.

Tile 1 is then conveyed from the air knife, or like fluid impinging means 5, under radiation precure means 6, which is an ultraviolet irradiator which directs UV light down upon the coating surface on tile 1. Particularly suitable ultraviolet precuring systems for use as radiation precure means include the "Model F440-10 Irradiator," commercially available from Fusion Systems Corporation, Dockville, Maryland, and the "Model I Processor," commercially available from Radiation Polymer Co., Plainville, Illinois, a subsidiary of PPG Industries. In addition to UV radiation, electron beam radiation can be employed in the practice of this invention.

The coated tile with fluid on at least a portion of the surface of the coating is typically exposed to the UV precure system for less than a second (e.g., to obtain a gloss level of 20 as measured by a 60° Gardner Glossometer, one possible combination of process conditions is: conveyor speed of about 70 feet per minute, an exposure gap on the precure system of about 6 inches, and an intensity of UV radiation of about 0.16 joules/cm$^2$).

The coated tile, moving away from the precure system, having a partially cured wear layer coating and having some fluid remaining on the surface of the wear layer coating is passed by fluid removing means 7 which in the drawing is shown to be an air knife. Simple alternative fluid removing means include a perforated tube, a fan or any means sufficient to draw air across the surface of the coated tile and thus remove fluid from the surface thereof.

Finally, if a fully radiation curable coating is employed, tile 1 would simply be passed under curing means 8 which could be a bank of UV lights directing sufficient UV radiation on the partially cured coating composition to complete the cure of the coating, and then the resulting tile, exhibiting a reduced level of surface gloss, is recovered. However, when using a combined radiation and moisture curable coating, the final cure means 8 must be supplemented by allowing the coating to age, and accordingly, the cure means 8 can include both radiation and moisture cure apparatus such as a UV irradiator and exposure to moisture by aging. At average room conditions, the above defined coating will develop its optimum properties within about three weeks.

Two flooring tiles were separately coated with 8 mils of the combined radiation and moisture curable coating composition set forth above and two flooring tiles were separately coated with 8 mils of a 100% radiation curable coating composition (Celrad 3300). Two tiles, each coated with a different one of the two coating compositions, were separately processed using substantially the best mode set forth above for practicing this invention. The process conditions were as follows: conveyor speed of about 80 feet per minute, exposure gap of about 6 inches, intensity of radiation of about 0.14 joules/cm$^2$. Both of the processed coated tiles were evaluated using a 60° Gardner Glossometer for amount of surface gloss reduction (gloss units) as compared to the other two tiles each separately coated with a different one of the two coating compositions but not processed according to this invention with the following results:

| Tile Coated With | Gloss (Units) Prior Art (Untreated) | Gloss (Units) Invention | % Gloss Reduction $\left(\frac{\text{Prior Art} - \text{Invention}}{\text{Prior Art}} \times 100\%\right)$ |
|---|---|---|---|
| 100% radiation curable coating | 96 | 3 | 97 |
| combined radiation moisture curable coating | 95 | 36 | 62 |

The above data indicate the effectiveness of the process and apparatus of the subject invention in reducing surface gloss.

As an alternative mode for practicing this invention, a portion of the uncured wear layer coated surface of tile 1 is cured by conveying and momentarily holding the coated tile under a partially masked irradiator such as a bank of UV lights 8 adapted with a shield before being conveyed under fluid impinging means 5. It is also possible to use a movable shield such that the tile does not have to be momentarily held under the irradiator. After being subjected to the remaining steps of the subject invention, tile 1 will exhibit a plurality of gloss levels in different areas.

In another alternative mode for practicing this invention, tile 1 is overall wear layer coated with a conventional high gloss coating composition using any suitable coating applicator, such as a curtain coater. The coating composition is then cured using any conventional curing means prior to being passed under means for coating 4 which, in this instance, is a screen or rotary printer, where a coating composition of this invention is applied to a portion of the surface of the conventional high gloss coating. After being subjected to the remaining steps of the subject invention, tile 1 will exhibit a plurality of gloss levels in different areas.

In another alternative mode for practicing this invention, tile 1, having been processed according to the best mode set forth above and exhibiting a low surface gloss, is passed in contact with a conventional printer, such as a screen or rotary printer, where a conventional high gloss coating is selectively applied to the deglossed surface of tile 1. Tile 1 is then passed under or through a conventional cure system to produce a tile exhibiting a plurality of gloss levels on different areas with the newly printed surface having a high gloss.

In another alternative, means for coating 4 consists of two consecutive conventional rotary type printers. Tile 1, having a decorative design on the surface thereof, provided by conventional printing and/or embossing means, is passed in contact with the first rotary printer where the 100% radiation curable coating described above is selectively printed in-register with the design on the tile surface. Tile 1 is then passed in contact with the second rotary printer where the 100% radiation and moisture curable coating described above is selectively printed in register with a portion of the design not previously printed. After being subjected to the remaining steps of the subject invention, tile 1 will exhibit a plurality of different gloss level areas in register with the design on the surface of the tile. In this instance, the areas corresponding to the printing of the 100% radiation curable coating will have a lower surface gloss than the areas corresponding to the printing of the 100% radiation and moisture curable coating.

It will be evident from the foregoing that various modifications can be made to this invention. Such, however, are considered to be within the scope of this invention.

What is claimed is:

1. A continuous manufacturing process for reducing the surface gloss of a coating composition which does not require the presence of flatting pigments to achieve gloss reduction, which process comprises:

(a) moving in a continuous manner a material which is to be coated on at least one surface;

(b) moving said material to a first station and applying at least one coating composition, which is at least partially radiation curable, on at least a portion of the surface of the material;

(c) moving said material to a second station and impinging the surface of the coating composition with a surface gloss-reducing fluid prior to and not simultaneous with radiation precure step (d) below to deposit some of said fluid on at least a portion of the surface of the coating composition;

(d) moving said material to a third station and subjecting at least a part of the coating composition to a radiation precure source to partially cure the coating composition while the surface gloss-reducing fluid applied above is still on the surface of the coating composition;

(e) moving said material to a fourth station and removing substantially all remaining surface gloss-reducing fluid applied above from the surface of the coating composition; and (f) moving said material to a fifth station and completing the cure of the coating composition.

2. The process of claim 1 which comprises, after the step of applying at least one coating composition, which is at least partially radiation curable, on at least a portion of the surface of the material and before the step of impinging the surface of the coating composition with a surface gloss-reducing fluid prior to and not simultaneous with radiation precure step (d) below to deposit some of said fluid on at least a portion of the surface of the coating composition, curing a portion of said coating composition.

3. The process of claim 1 which comprises applying and curing a glossy coating composition on the surface of said material prior to the step of applying thereover at least one coating composition on at least a portion of the surface of the material.

4. The process of claim 1 which comprises, after the step of completing the cure of the coating composition, to produce a cured coating, applying and curing a glossy coating composition on a portion of the surface of said prior cured coating.

5. The process of claim 1 which comprises applying in step (b) a first coating composition on a portion of the surface of said material the thereafter applying a second coating composition on a portion of the surface of said material, prior to impinging the surface with a surface gloss-reducing fluid, said first coating composition and said second coating composition having different percent by weight radiation curable values.

6. The process of claim 5 in which said material has a decorative design on the surface thereof and said first and said second coating compositions are applied in register with said design.

7. The process of claim 1 in which said coating composition is 100% radiation curable.

8. The process of claim 1 in which said coating composition is 100% curable by combined radiation and moisture curing.

9. The process of claim 8 in which at least about 5% by weight of said composition is radiation curable.

10. A wear layer coated floor covering having a reduced surface gloss produced according to the process of claim 1.

11. A wear layer coated floor covering having a plurality of surface gloss levels in different areas produced by the process of claim 2.

12. A wear layer coated floor covering having a plurality of surface gloss levels in different areas produced by the process of claim 3.

13. A wear layer coated floor covering having a plurality of surface gloss levels in different areas produced by the process of claim 4.

14. A wear layer coated floor covering having a plurality of surface gloss levels in different areas produced by the process of claim 5.

15. A wear layer coated floor covering have a plurality of surface gloss levels in different areas produced by the process of claim 6.

16. Apparatus for reducing the surface gloss of a coating composition which does not require the presence of flatting pigments to achieve gloss reduction, which apparatus comprises:

(a) means for moving in a continuous manner a material which is to be coated on at least one surface;

(b) means for applying the coating composition, which is at least partially radiation curable, on at least a portion of the surface of the material;

(c) means for impinging the surface of the coating composition with a surface gloss-reducing fluid prior to and not simultaneous with radiation precure step (d) below to deposit some of said fluid on at least a portion of the surface of the coating composition;

(d) means for partially radiation curing the coating composition while the surface gloss-reducing fluid is still on the surface of the coating composition;

(e) means for removing substantially all remaining surface gloss-reducing fluid from the surface of the coating composition; and (f) means for completing the cure of the coating composition.

17. A continuous manufacturing process for reducing the surface gloss of a coating composition which does not require the presence of flatting pigments to acheive gloss reduction, which process comprises:

(a) moving in a continuous manner a material which is to be coated on at least one surface;

(b) moving said material to a first station and applying at least one coating composition, which is at least partially radiation curable on at least a portion of the surface of the material;

(c) moving said material to a second station and impinging the surface of the coating composition with steam as a surface gloss-reducing fluid to deposit some of said fluid as liquid water by condensation on at least a portion of the surface of the coating composition;

(d) moving said material to a third station and subjecting at least a part of the coating composition to a radiation precure source to partially cure the coating composition while the surface gloss-reducing fluid applied above is still on the surface of the coating composition;

(e) moving said material to a fourth station and removing substantially all remaining surface gloss-reducing fluid applied above from the surface of the coating composition; and (f) moving said material to a fifth station and completing the cure of the coating composition.

* * * * *